United States Patent [19]

Wirz et al.

[11] 4,127,265

[45] Nov. 28, 1978

[54] SHEET SENSING DEVICE IN A ROTARY PRINTING PRESS

[75] Inventors: Arno Wirz; Willi Becker, both of Bammental, Fed. Rep. of Germany

[73] Assignee: Heidelberger Druckmaschinen AG, Heidelberg, Fed. Rep. of Germany

[21] Appl. No.: 795,874

[22] Filed: May 11, 1977

[30] Foreign Application Priority Data

May 13, 1976 [DE] Fed. Rep. of Germany ..... 2621250

[51] Int. Cl.[2] ..... B65H 7/12

[52] U.S. Cl. ..... 271/260; 101/409; 271/82; 271/196; 271/261; 271/276; 271/277

[58] Field of Search ..... 271/260, 261, 276, 275, 271/277, 196, 197, 204, 82; 101/409–412

[56] References Cited

U.S. PATENT DOCUMENTS

| | | | |
|---|---|---|---|
| 1,790,465 | 1/1931 | Dudley | 271/260 X |
| 3,618,935 | 11/1971 | Howatt | 271/276 |
| 4,024,814 | 5/1977 | Becker | 271/276 X |
| 4,029,009 | 6/1977 | Kuhn | 271/276 X |

FOREIGN PATENT DOCUMENTS

| | | | |
|---|---|---|---|
| 670,765 | 9/1963 | Canada | 271/276 |

*Primary Examiner*—Richard A. Schacher
*Attorney, Agent, or Firm*—Herbert L. Lerner

[57] ABSTRACT

Sheet sensing device in a rotary printing press having a sheet transferring drum provided at respective regions thereof with gripping means for gripping the leading and trailing edges of a sheet being transferred, includes sensing nozzles disposed in the region of the gripping means for gripping the trailing edge of a sheet, a line system connecting the sensing nozzles to a pneumatic pressure-generating source, and pressure monitoring means connected in the line system between the sensing nozzles and the pneumatic pressure-generating source.

9 Claims, 12 Drawing Figures

SHEET SENSING DEVICE IN A ROTARY PRINTING PRESS

The invention relates to a sheet sensing device in a rotary printing press, particularly for perfector printing, having sheet delivery or transferring drums provided with gripping means for seizing the front or leading edge and the rear or trailing edge of sheets being transferred.

A sheet-fed offset printing press for perfector printing, having a sheet turning station provided between the first and second printing units thereof, the sheet turning station being formed of two sheet transfer drums and one turning drum, has become known heretofore. Below this turning drum, a electronic sensing eye is provided to establish whether or not a sheet is being transferred or fed from the turning drum grippers to the impression cylinder of the second printing unit.

This electronic sensing device is very susceptible to paper dust and must, therefore, be cleaned often. Sensing occurs as the sheet passes, and false indications cannot, therefore, be ruled out, especially for higher printing speeds. The electronic sensing device can, for example, only establish the absence of a sheet, but turned-over or folded sheet corners, which could damage the rubber blanket of the second printing unit, or a sheet which has been gripped by the grippers at a slant or with inadequate gripping contact, would not be signaled by the heretofore known electronic sensing eye. Faulty signals, however, cause either a machine stoppage or at least mackling and spoilage and possible damage to the rubber blanket. Moreover, such electronic sensing devices are very expensive.

It is accordingly an object of the invention to provide a sheet sensing device in a rotary printing press which establishes early, reliably and with minimal expense, whether a fault-free sheet is being transferred with proper orientation or positioning by the sheet transfer drums or the entire sheet turning station to the following printing unit.

With the foregoing and other objects in view, there is provided in accordance with the invention, a sheet sensing device in a rotary printing press having a sheet transferring drum provided at respective regions with gripping means for gripping the leading and trailing edges of a sheet being transferred, comprising sensing nozzles disposed in the region of the gripping means for gripping the trailing edge of a sheet, a line system connecting the sensing nozzles to a pneumatic pressure-generating source, and pressure monitoring means connected in the line system between the sensing nozzles and the pneumatic pressure-generating source.

Sensing occurs during relative immobility i.e. the sheet on the sheet transfer drums and the sensing nozzles virtually do not move relative to one another while the sensing operation is in progress. The sensing operation is, therefore, extremely reliable. Moreover, it occurs very early so that even with high printing speed the rotary printing press can always be stopped in time, or the pressure turned off. With a disposition of the sensing nozzles along the entire length of a sheet transfer drum, not only sheets that are gripped or seized at a slant but also faults at the edge of the gripped sheet, such as torn-off portions of the sheet and folded corners, can be sensed.

In accordance with another feature of the invention, the gripping means for gripping the trailing edge of a sheet are constructed as suction grippers and serve simultaneously as the sensing nozzles.

The suction grippers and the sensing nozzles are thus identical. Only a small expense, namely, merely providing for a pressure monitor or guard in the feeder or line system, is required to ensure perfect supervision of the sheet transfer by sheet transfer drums. This development of the invention is, therefore, also quite suitable for the refitting of a pneumatic sheet-transport installation in already-existing rotary printing presses.

In accordance with a further feature of the invention, the sheet transferring drum is formed with a drum channel, the suction grippers extending in a row alongside the drum channel, at least two of the suction grippers located substantially in a middle region of the row of suction grippers being offset with respect to the others of the suction grippers and being closer to the drum channel than the others of the suction grippers.

The length of a sheet can thereby be measured with an accuracy of less than one millimeter. In rotary printing presses of the perfecting type having a sheet turning station, this ensures that sheets which are too short and are recognized as such, and corresponding commands can be introduced for the control of the machine, e.g. stopping the printing in the next printing unit.

For processing narrower formats, in accordance with an added feature of the invention, means are provided for selectively regulating and shutting off individually the suction effects of the suction grippers and the sensing nozzles. The features is also of advantage for the processing of thinner papers because, in such cases, the danger of the thin papers being sucked locally into the nozzles exists, which can possibly cause deformation of the sheet gripped by the suction grippers and sensed.

In accordance with an additional feature of the invention, the suction grippers serving simultaneously as sensing nozzles are rotary suckers comprising respective disc members controllably rotatable about a rotary axis extending substantially perpendicularly to the axis of rotation of the sheet transferring drum, the disc members being formed, respectively, with a suction hole located eccentrically to the axis of rotation of the respective disc members.

The rotary suckers serve to tension the sheets on the sheet transfer drum. At the beginning of each tensioning process, the suction holes located eccentrically with respect to the axis of rotation of each disc are their farthest from the cylinder or drum channel. During the tensioning of the sheet, they approach the drum channel wall. The initial position of the suction openings at the start of tensioning and sensing operation has the advantage that sheets which do not lie smoothly or tautly on the sheet transfer drum are not signaled as being too short, so that no unnecessary maloperations or faulty switchings occur. During the sensing process, therefore, the sensing nozzles according to this embodiment move towards the drum channel of the sheet transfer drum and, should the tautened sheet be too short, the suction openings travel beyond the trailing edges of the sensed sheet and effect, for example, the shut-down of the rotary printing press.

In accordance with yet another feature of the invention, which is a particularly advantageous development with regard to the processing of thin sheets, the sheet transferring drum is formed with a drum channel, the rotary suckers extending in a row alongside the drum channel, at least two of the rotary suckers located substantially in a middle region of the row of rotary suckers being offset with respect to the others of the rotary suckers and being closer to the drum channel than the others of the rotary suckers, the suction holes respectively formed in the rotary suckers closer to the drum channel having a smaller cross section than that of the respective suction holes formed in the others of the rotary suckers.

The small cross-section of these suction openings results in a throttling effect which reduces the suction force of the rotary suckers located closer to the drum channel with respect to that of the others in the row. This results in a protection of thin papers in the vicinity of the trailing edge of the sheet.

In accordance with yet a further feature of the invention, the sheet transferring drum is formed with a drum channel, and the gripping means for gripping the trailing edge of a sheet extend row-wise adjacent the drum channel, the sensing nozzles being disposed between the gripping means for gripping the trailing edge of a sheet and the drum channel, and including air control means for controlling pneumatic pressure connected in the line system and connecting the sensing nozzles through the intermediary of the pressure monitoring means to the pneumatic pressure-generating source.

The additional sensing nozzles can be controlled separately. Thus, the sensing operation can occur under reduced pressure. Separate nozzles have the further advantage that they can be fitted better to the circumference of the cylinder or drum, thus contributing to accurate sheet transfer particularly with small-diameter sheet transfer drums. If the sensing nozzles should lie on a secant within the circumference of the sheet transfer drum, the trailing edge of the sheet would be sucked inwardly, and the grippers lying on the circumference of the next sheet transfer drum would lift the trailing edge of the sheet up again, resulting in a wavy transfer. The stronger this waviness is, the greater the danger of image deterioration in the following printing units due to a more inexact transfer.

In accordance with another feature of the invention, the gripping means for gripping the trailing edge of a sheet comprise a plurality of suction grippers, the sensing nozzles are in the form of suction nozzles, and the air control means and the pressure monitoring means constitute respective single devices to which the suction grippers and the sensing nozzles are connected in common. Thus, an especially economical development is afforded by employing sucking gripper means as a feature of the invention.

In accordance with a concomitant feature of the invention, the sensing nozzles are formed as blower nozzles. Blower nozzles are self-cleaning and hence maintenance-free. Sensing nozzles working with blown or compressed air can be used best in connection with grippers. They can also be used, however, with gripper means constructed as suckers, since the positive pressure used for sensing can be held low enough that the blasting or blown-air pressure exerted locally exerts a force on the sheet which is less, many times over, than the force of the suction grippers which grip the trailing edge of the sheet.

Other features which are considered as characteristic for the invention are set forth in the appended claims.

Although the invention is illustrated and described herein as embodied in sheet sensing device in a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
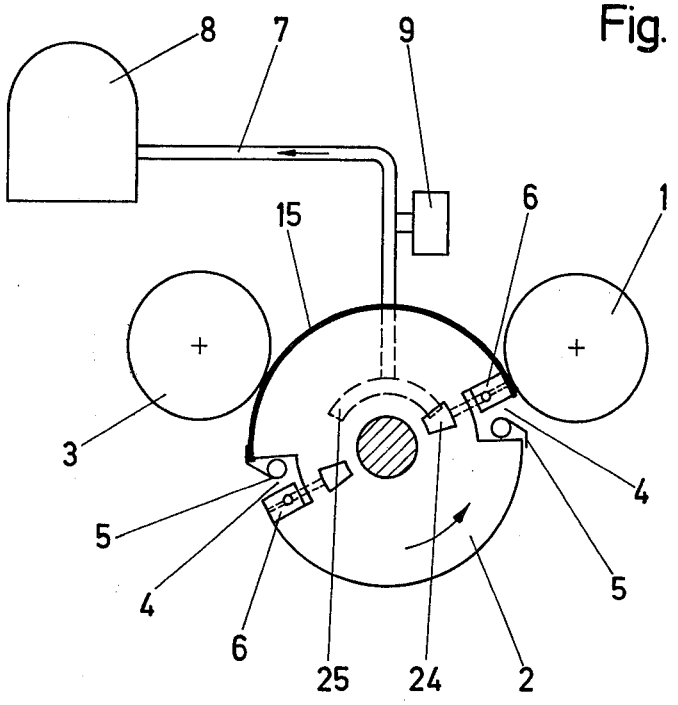
FIG. 1 is a diagrammatic view of a sheet turning station with suction grippers to grip the back edge of sheets that are simultaneously constructed as sensing nozzles.

Referring now to the drawing and first, particularly, to FIG. 1 thereof, there is shown a sheet turning station for a multicolor sheet-fed rotary printing press which can be changed over from first-form printing to perfector printing. This sheet turning station is formed of three sheet transfer drums disposed between two successive printing units. The printing units themselves are not represented. The first sheet transfer drum 1 accepts the sheet from the impression cylinder of the preceding printing unit and transfers it to the middle sheet transfer drum in the middle, hereinafter referred to as a storage drum 2. In the perfector printing position of the sheet turning station, the third sheet transfer drum, which is provided with a sheet-turning device and hence called a turning drum 3, accepts or takes over the sheet fed from the storage drum 2, grips it at the trailing edge thereof and feeds it, turned over, to the impression cylinder of the following printing unit.

The storage drum 2 has twice the diameter of the sheet transfer drum 1 and the turning drum 3. Correspondingly, it is equipped with two diametrically opposed drum channels 4. At the rear wall of each of the drum channels 4, a row of clamping grippers 5 for seizing the leading edge of the sheets is provided and, at the front wall of the respective channels 4, a row of suction grippers 6 to hold the trailing edge of the sheets.

The suction grippers 6 are connected to a negative-pressure generator 8 through a pressure line 7. In order for the suction grippers 6 to be able to function as sensing nozzles, the pressure line 7 is connected to a pressure monitor 9 controlled with respect to the sensing period.

Figure 2:
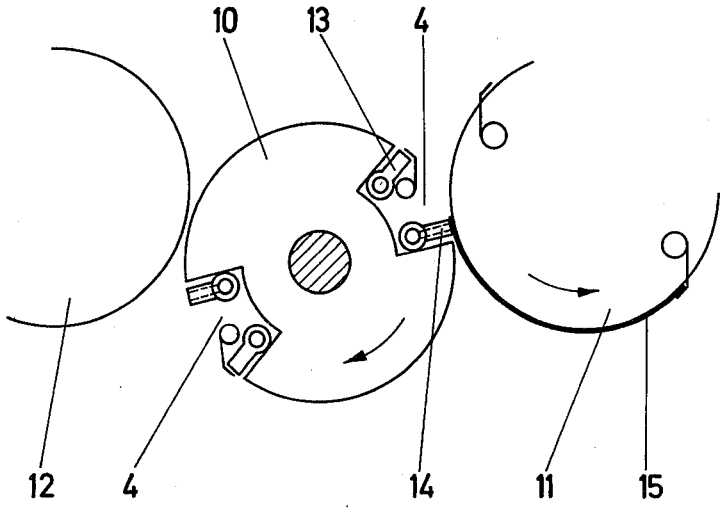
FIG. 2 is a diagrammatic view of a sheet turning drum with pivotable suction grippers acting as sensing nozzles.

FIG. 2 also shows a sheet turning station of a multicolor sheet-fed rotary printing press which can be changed over from first-form printing to perfector printing, yet is formed of only a single turning drum 10. The impression cylinder 11 of the preceding printing unit, just like the impression cylinder 12 of the following printing unit, has two printing surfaces. The turning drum 10, correspondingly, has two sheet transfer surfaces. At the rear wall in the two drum channels 4 of the turning drum 10, clamping grippers 13 are provided which are pivotable and are able to take over a sheet 15 inside the drum channel 4 for the purpose of turning it over. Viewed in the direction of rotation, the front wall of the cylinder channel 4 is provided with a row of pivotable suction grippers 14 which seize the trailing edge of a sheet 15 carried by the impression cylinder 11 and transfer it, during the further continued rotation of the turning drum 10, to the clamping grippers 13 inside the drum channel 4. The suction grippers 14 are simultaneously constructed as sensing nozzles.

Figure 3:
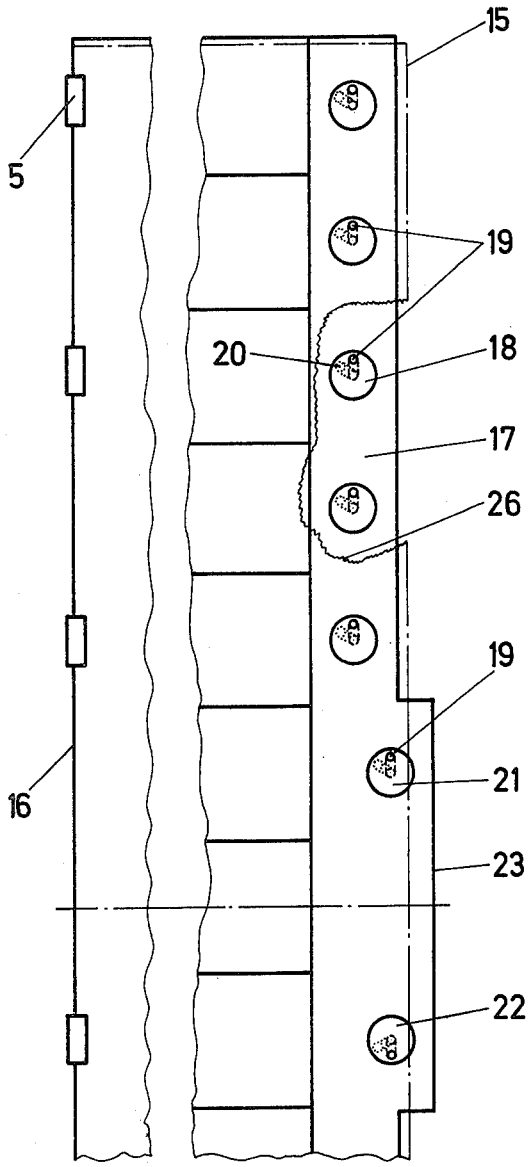
FIGS. 3 to 5 are fragmentary plan views of the sheet turning drum showing the action of the sensing nozzles that are constructed as rotary suckers.

FIG. 3 shows one of the possible dispositions and uses of suction grippers 6 as sensing nozzles according to FIG. 1. It provides a diagrammatic view of a sheet guiding surface of the storage drum 2. The clamping grippers 5 have seized the leading edge 16 of the sheet 15. At the back or trailing end of this sheet guiding surface of the storage drum 2, a suction bar 17 is provided, equipped with a row of disc-shaped rotary suckers 18. Each of these rotary suckers 18 has an eccentric suction hole 19 which also acts simultaneously as a sensing nozzle. The suction hole 19 is disposed eccentrically to the axis of rotation of the disc-shaped rotary sucker 18 and can be moved during a sheet tensioning operation, through a non-illustrated lever system, from the position 20 thereof, shown in phantom, into the position thereof shown in solid lines, by rotation of the disc-shaped rotary suckers 18. In the middle region of the row of the rotary suckers 18 disposed along the drum channel 4, two rotary suckers 21 and 22 are located offset from the others. They lie closer to drum channel wall 23 than the other rotary suckers 18. The suckers 21 and 22 have the function or task of determining the length of sheets.

FIG. 1 represents the moment when the suction grippers 6 are located opposite the end or trailing edge of sheet 15. The suction holes 19 of the rotary suckers 18 are then in the position 20 shown in phantom in FIG. 3. As is also shown in FIG. 1, a control opening 24 has gone past the front wall of a control groove 25 so that the negative pressure generated by the negative-pressure generator 8 produces suction through the pressure line 7, which is applied to the trailing end of the sheet 15. With continued rotation of the storage drum 2, the rotary suckers 18, 21 and 22 are swung into the position thereof shown in solid lines and the pressure monitor 9 does not cause the printing press to be turned off, provided the sheet is free of any faults and has been transferred correctly. Should a portion of the trailing edge of the sheet be torn off, however, as shown in FIG. 3 at 26, these rotary suckers 18 suck in air and the negative pressure collapses or is reduced correspondingly. The pressure monitor 9 signals a fault, and the printing press switches off. Such commercially available pressure monitors can be adjusted to the desired pressure difference.

Figure 5:
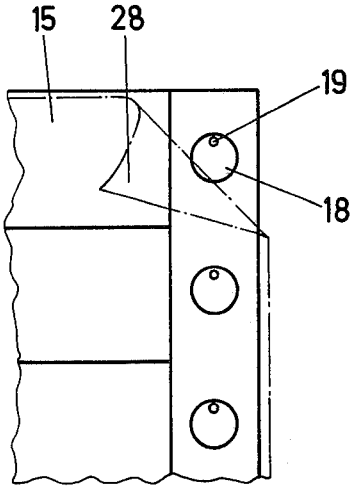
Figure 4:
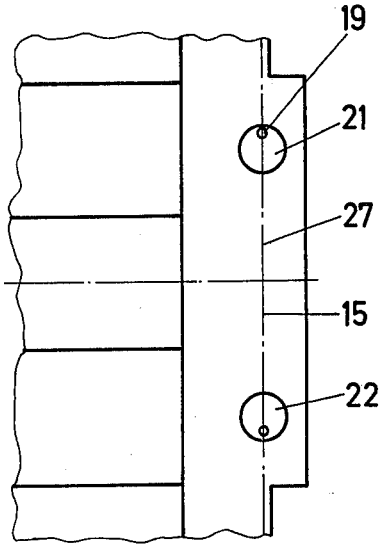

FIGS. 4 and 5 show two other sources of faults often causing malfunctions during run-on, particularly with perfector printing. In FIG. 4, the sheet 15 is too short. It would then not be taken over correctly by the grippers of the turning drum 3. In FIG. 4, the offset rotary suckers 21 and 22 are in the end position thereof at the end of the tensioning phase of the sheet. The suction hole 19 of each rotary sucker 21 and 22 has then half-passed the trailing edge 27 of the sheet. This slight release or clearance of the suction hole 19 is already sufficient, however, to reduce the negative pressure sufficiently for the pressure monitor 9 to effect a stoppage of the printing press or of the printing.

FIG. 5 shows a turned-over or folded corner 28 of the sheet 15. At the very start of the tensioning process, the suction hole 19 of the outermost rotary sucker 18 is already not covered so that the pressure monitor 9 causes the machine to be stopped immediately when the negative pressure is applied.

Figure 6:
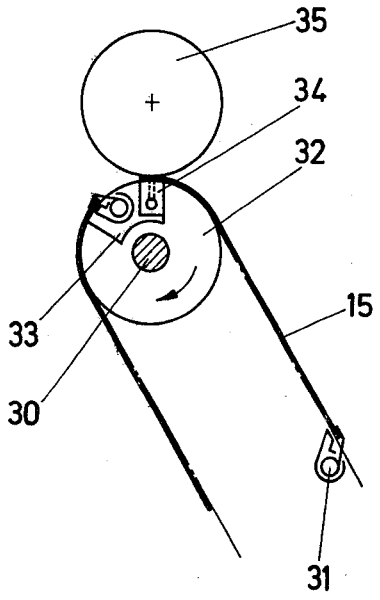
FIG. 6 is a diagrammatic view of suction grippers formed as sensing nozzles on a sheet transfer drum disposed on a chain or sprocket wheel shaft.

The invention can also be used to advantage with sheet transfer and transport by means of chain grippers. FIG. 6 shows such an embodiment. On a chain-wheel or sprocket shaft 30 of a chain gripper system 31, a sheet transfer drum 32 is disposed and is provided at the front wall of the drum channel 33 thereof with a suction bar 34. This serves to hold the trailing edge of the sheet 15 that is fed past a turning drum 35 by the chain gripper system 31, until the grippers of the turning drum 35 have securely gripped the trailing edge of the sheet 15.

Figure 7:
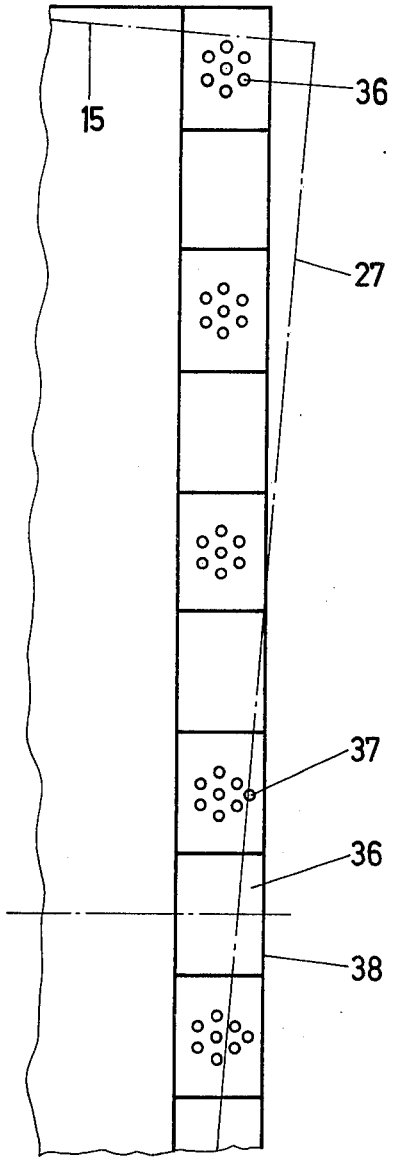
FIG. 7 is an enlarged fragmentary plan view of a suction bar for a sheet transfer drum according to FIG. 6.

FIG. 7 shows the construction of this suction bar 34. The suction bar 34 is formed with uniformly spaced suction holes 36 which are disposed symmetrically with respect to each other. They serve simultaneously as suction grippers and as sensing nozzles. In the middle region of the suction bar 34, a respective additional sensing hole 37 is provided, besides the usual group of suction holes 36. The sensing holes 37 are disposed closest to the drum channel wall 38. If the trailing edge 27 of a sheet 15 is too short or if this sheet 15 is even just slightly at a slant, the negative pressure system of the suction bar 34 becomes exposed to the air, and a non-illustrated pressure monitor causes the rotary printing press or the printing thereof to be stopped.

Figure 8:
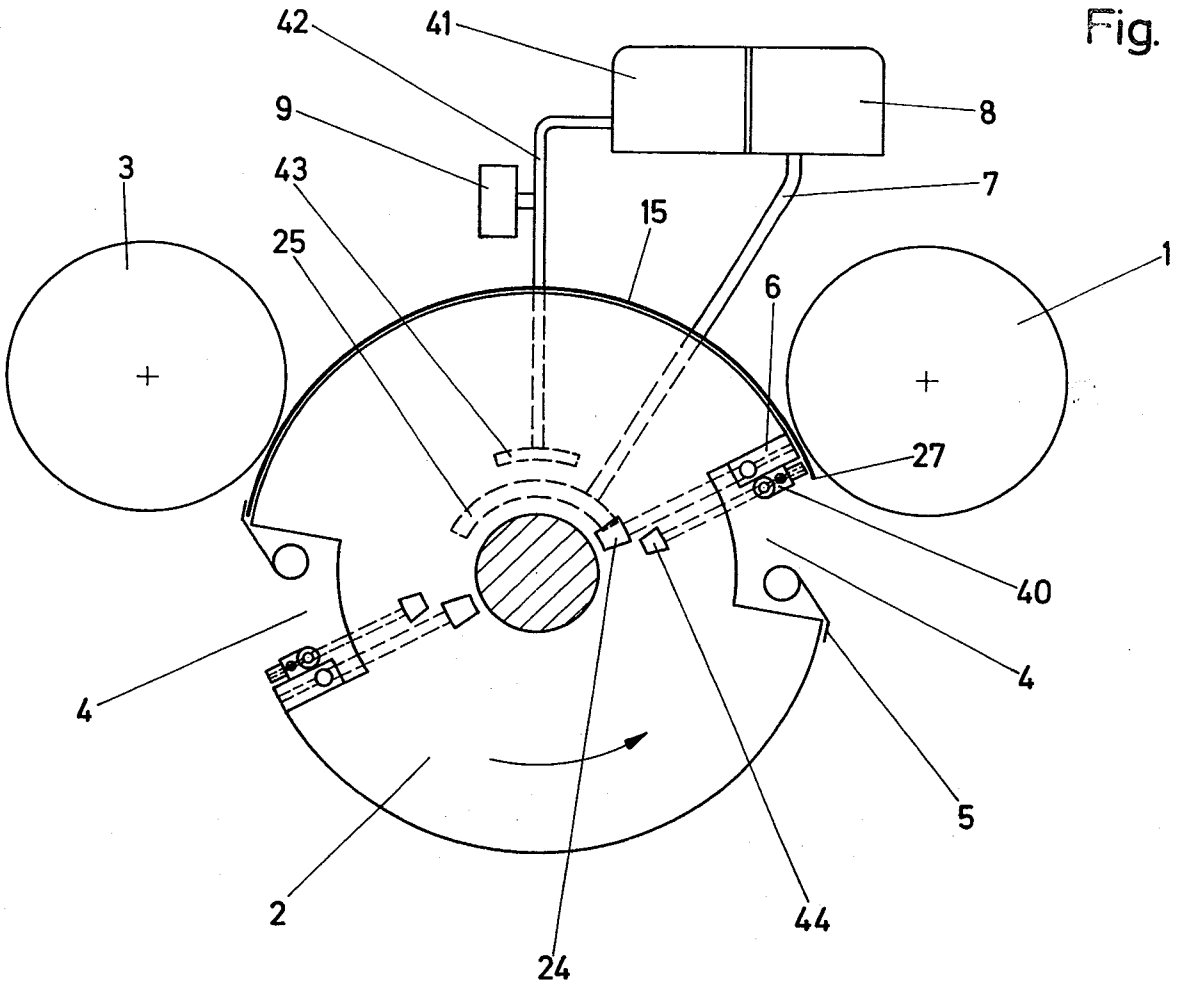
FIG. 8 is a diagrammatic view of a sheet turning station in which suction grippers and sensing nozzles are connected to separate negative-pressure generators.

FIG. 8 shows a sheet turning station for multi-color sheet-fed rotary printing presses wherein the printing-unit cylinders have a relatively small diameter i.e. the circumference of the individual drums has a relatively high curvature.

Figure 11:
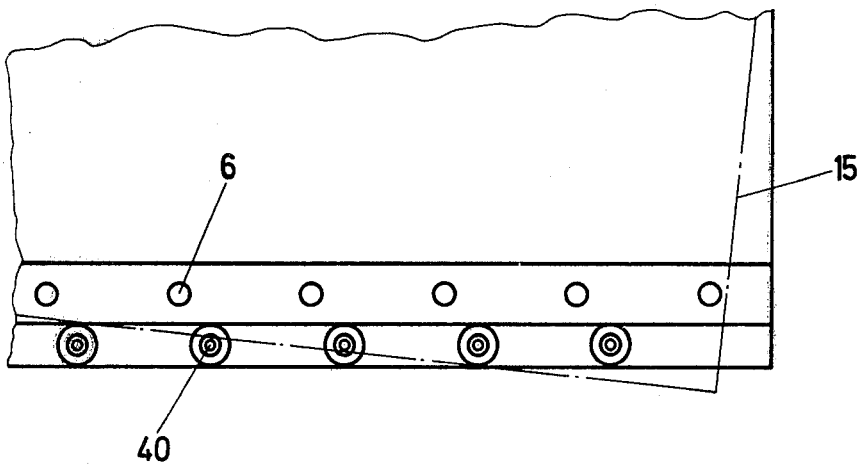
FIGS. 11 and 12 are fragmentary plan views, respectively, of FIGS. 8 and 10 showing special dispositions of the sensing nozzles.

Like that in FIG. 1, this sheet-turning station of FIG. 8 is made up of the sheet transfer drum 1, the storage drum 2 and the turning drum 3. The drum channels 4 are provided with clamping grippers 5 and suction grippers 6 analogously to the embodiment of FIG. 1. Besides the suction grippers 6, however, additional sensing nozzles 40 are disposed inside the drum channels 4. They extend in a row parallel to the row of suction grippers 6 (note FIG. 11). As viewed in the direction of rotation of the storage drum 2, the additional sensing nozzles 40 follow the suction grippers 6. The suction surface of the sensing nozzles 40 can be disposed high enough so as to lie exactly on the circumference of the storage drum 2 so that the trailing edge of the sheet is not sucked inwardly during the sensing, with the consequent danger that the trailing edge of the sheet would be transferred wavily to the grippers of the turning drum 3.

Besides the negative-pressure generator 8, which supplied negative pressure through the pressure line 7, the control channel 25 and the control opening 24 to the suction grippers 6, a further negative-pressure generator 41 is provided which can produce an intermittent negative pressure in the sensing nozzles 40 through a pressure line 42, a control groove 43 and a control opening 44. A pressure monitor 9 is connected into the pressure line 42. Due to the disposition of a separate negative-pressure generator 41, the sensing nozzles 40 are able to work with low constant pressure. The low constant pressure does not have to be adjusted to the various types of paper to be handled, as, for example, when suction grippers are simultaneously employed as sensing nozzles, which means that the pressure monitor 9 also does not have to be regulated.

Figure 9:
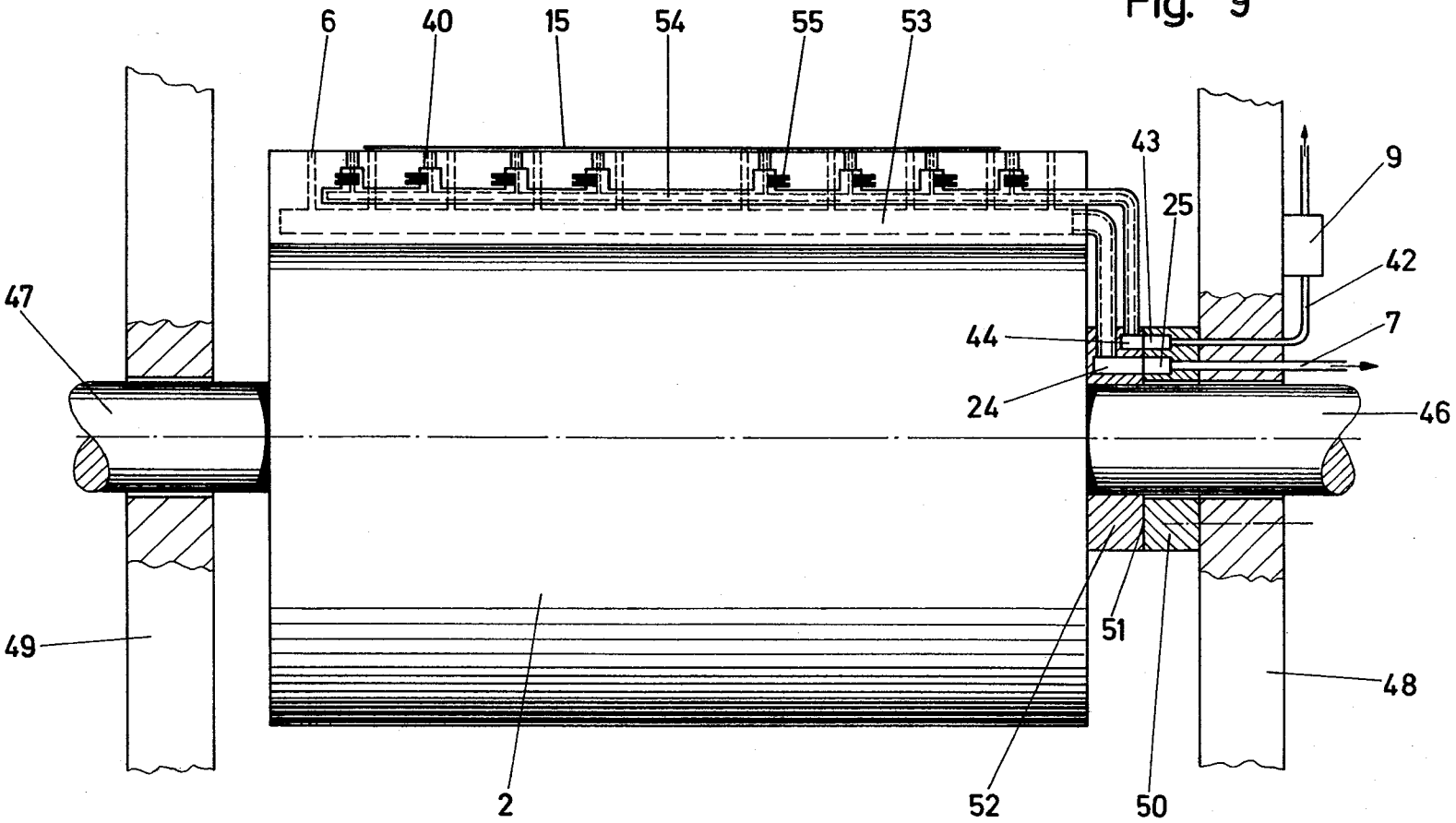
FIG. 9 is a longitudinal view, partly in section and partly schematic showing a storage drum forming part of the sheet turning station of FIG. 8.

FIG. 9 shows diagrammatically a side view of the storage drum 2 wherein the storage drum 2 is supported in the side wall 48 of the frame on a journal 46 and in the opposite side wall 49 of the frame on another journal 47. At the inside of the first-mentioned frame side wall 48, a valve ring 50 is mounted symmetrically to the journal 46, and on the free front side 51 of the valve ring 50, there runs a valve ring 52 of the same size which is firmly anchored to the storage drum 2. The valve ring 50 mounted on the frame side wall 48 is formed with control grooves 25 and 43 which are connected to the negative-pressure generator 8 or 41 associated therewith by means of the pressure line 7 or the pressure line 42, respectively, and the pressure monitor 9. The hereinaforementioned control openings 24 and 44 are located in the valve ring 52 rotating with the storage drum 2. The control opening 24 is connected to the suction grippers 6 through a suction pipe 53, and the control opening 44 is connected to the sensing nozzles 40 through another suction pipe 54.

The sensing nozzles 40 are provided with regulating screws 55 by means of which either the suction effect is regulated or the connection of sensing nozzle 40 to suction pipe 54 can be interrupted. Should the format of a sheet 15, for example, as shown in FIG. 9, be narrower than the sheet transport surface of the storage drum 2, the outer sensing nozzles 40 can be turned off by screwing in the regulating screws 55. When there are two negative-pressure generators 8 and 52, as in the embodiment according to FIG. 8, the sensing nozzles 40 can naturally also be constructed as blower nozzles. This has the advantage that they are always self-cleaning and hence maintenance-free.

Figure 10:
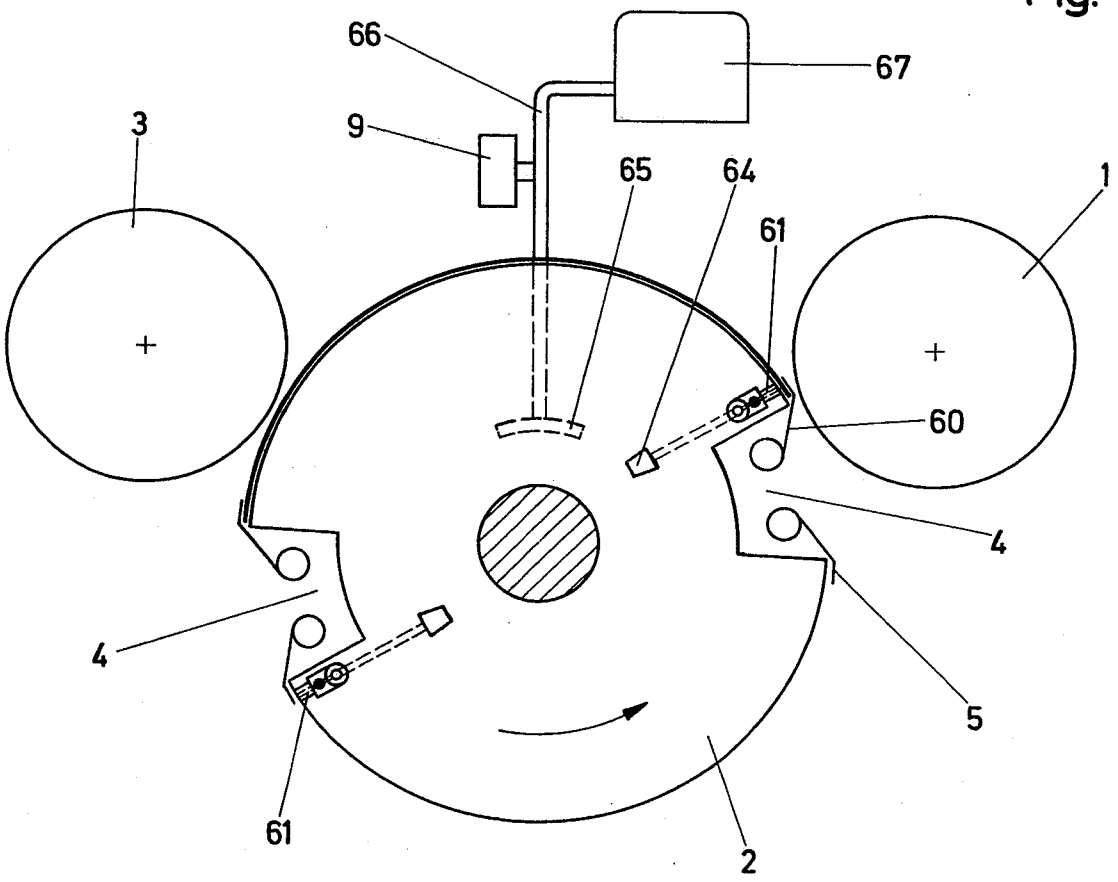
FIG. 10 is a diagrammatic view of a sheet turning station with clamping grippers to grip the trailing edge of sheets and with sensing nozzles constructed as blast-nozzles.
Figure 12:
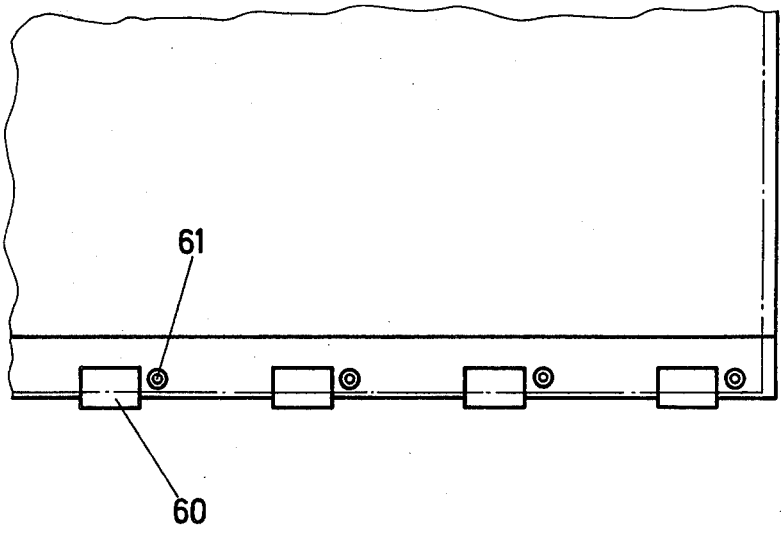

The use of blower nozzles is of particular advantage, however, in conjunction with clamping grippers, as shown in FIG. 10. This figure also shows a sheet turning station made up of the sheet transfer drum 1, the storage drum 2 and the turning drum 3. The drum channels 4, however, in addition to the clamping grippers 5 for seizing the leading edge of the sheet, are equipped with a further row of clamping grippers 60 for seizing the trailing edge of the sheet. Immediately next to each clamping gripper 60, a sensing nozzle formed as a blower nozzle 61 is disposed, as can be seen in FIG. 12. The blower nozzles 61 are connected to a positive pressure generator 67 through a control opening 64, a control channel 65 and a pressure line 66. A pressure monitor 9 is connected into the pressure line 66. An extremely small amount of positive pressure is adequate to sense the rear or trailing area of the sheet. Even when processing onion-skin paper, therefore, the trailing edge of the sheet can be sensed without having the thin sheet being blown high up. The diameter of the sensing nozzles can be kept extremely small so that even slight deviations in the lengths of the sheets or in the formation of the trailing edge of the sheets effect a shutdown of the rotary printing press through the pressure monitor.

There are claimed:

1. Sheet sensing device in a rotary printing press having a sheet transferring drum provided at respective regions thereof with gripping means for gripping the leading and trailing edges of a sheet being transferred, comprising sensing nozzles disposed in the region of the gripping means for gripping the trailing edge of a sheet, said sensing nozzles extending across the drum over a distance corresponding to the entire width substantially of the sheet being transferred, a line system connecting said sensing nozzles to a pneumatic pressure-generating source, and pressure monitoring means connected in said line system between said sensing nozzles and said pneumatic pressure-generating source.

2. Sheet sensing device according to claim 1 wherein the gripping means for gripping the trailing edge of a sheet are constructed as suction grippers and serve simultaneously as said sensing nozzles.

3. Sheet sensing device according to claim 2 including means for selectively regulating and shutting off individually the suction effects of said suction grippers and sensing nozzles.

4. Sheet sensing device according to claim 2 wherein said suction grippers serving simultaneously as sensing nozzles are rotary suckers comprising respective disc members controllably rotatable about a rotary axis extending substantially perpendicularly to the axis of rotation of the sheet transferring drum, said disc members being formed, respectively, with a suction hole located eccentrically to the axis of rotation of the respective disc member.

5. Sheet sensing device according to claim 1 wherein the sheet transferring drum is formed with a drum channel, and said gripping means for gripping the trailing edge of a sheet extend row-wise adjacent said drum channel, said sensing nozzles being disposed between said gripping means for gripping the trailing edge of a sheet and said drum channel, and including air control means for controlling pneumatic pressure connected in said line system and connecting said sensing nozzles through the intermediary of said pressure monitoring means to said pneumatic pressure-generating source.

6. Sheet sensing device according to claim 5 wherein said gripping means for gripping the trailing edge of a sheet comprise a plurality of suction grippers, said sensing nozzles are in the form of suction nozzles, and said air control means and said pressure monitoring means constitute respective single devices to which said suction grippers and said sensing nozzles are connected in common.

7. Sheet sensing device according to claim 5 wherein said sensing nozzles are formed as blower nozzles.

8. Sheet sensing device in a rotary printing press having a sheet transferring drum provided at respective regions thereof with gripping means for gripping the leading and trailing edges of a sheet being transferred, comprising sensing nozzles disposed in the region of the gripping means for gripping the trailing edge of a sheet, a line system connecting said sensing nozzles to a pneumatic pressure-generating source, and pressure monitoring means connected in said line system between said sensing nozzles and said pneumatic pressure-generating source, the gripping means for gripping the trailing edge of a sheet being constructed as suction grippers and serving simultaneously as said sensing nozzles, the sheet transferring drum being formed with a drum channel, said suction grippers extending in a row alongside said drum channel, at least two of said suction grippers located substantially in a middle region of said row of suction grippers being offset with respect to the others of said suction grippers and being closer to said drum channel than the others of said suction grippers.

9. Sheet sensing device in a rotary printing press having a sheet transferring drum provided at respective regions thereof with gripping means for gripping the leading and trailing edges of a sheet being transferred, comprising sensing nozzles disposed in the region of the gripping means for gripping the trailing edge of a sheet, a line system connecting said sensing nozzles to a pneumatic pressure-generating source, and pressure monitoring means connected in said line system between said sensing nozzles and said pneumatic pressure-generating source, the gripping means for gripping the trailing edge of a sheet being constructed as suction grippers and serving simultaneously as said sensing nozzles, said suction grippers serving simultaneously as sensing nozzles being rotary suckers comprising respective disc members controllably rotatable about a rotary axis extending substantially perpendicularly to the axis of rotation of the sheet transferring drum, said disc members being formed, respectively, with a suction hole located eccentrically to the axis of rotation of the respective disc member, the sheet transferring drum being formed with a drum channel, said rotary suckers extending in a row alongside said drum channel, at least two of said rotary suckers located substantially in a middle region of said row of rotary suckers being offset with respect to the others of said rotary suckers and being closer to said drum channel than the others of said rotary suckers, the suction holes respectively formed in the rotary suckers closer to said drum channel having a smaller cross section than that of the respective suction holes formed in the others of said rotary suckers.

* * * * *